United States Patent [19]

Matsumoto

[11] 4,056,918

[45] Nov. 8, 1977

[54] WINDING MACHINE

[75] Inventor: Yukimichi Matsumoto, Hirakata, Japan

[73] Assignee: Kabushiki Kaisha Fuji Tekkosho, Japan

[21] Appl. No.: 730,996

[22] Filed: Oct. 8, 1976

[30] Foreign Application Priority Data

Oct. 11, 1975 Japan ..... 50-122590

[51] Int. Cl.[2] ..... B65B 63/04

[52] U.S. Cl. ..... 53/118; 53/133; 242/56 A

[58] Field of Search ..... 53/21 FW, 118, 133; 242/56 A, 65

[56] References Cited

U.S. PATENT DOCUMENTS

| | | | |
|---|---|---|---|
| 2,385,692 | 9/1945 | Corbin et al. | 242/65 X |
| 2,661,582 | 12/1953 | Hanser | 53/133 X |
| 2,668,675 | 2/1954 | Wolfe | 242/56 A |
| 3,848,824 | 11/1974 | Van Schijndel | 242/65 X |

*Primary Examiner*—Travis S. McGehee
*Attorney, Agent, or Firm*—Robert E. Burns; Emmanuel J. Lobato; Bruce L. Adams

[57] ABSTRACT

A method and roll-winding apparatus for automatically winding into rolls a sheet of material and automatically applying a leader tape to the trailing end of a length of sheet material wound into a roll. The trailing end section may likewise be automatically reversely folded outwardly over itself to form a tab on the wound roll for easy removal of the sheet material on a wound roll. The apparatus carries out the method automatically with a continuously driven winding drum to which elongated cores are presented sequentially parallel thereto for driving of the cores individually and transversely of a path of travel of the longitudinally travelling sheet material to be wound as corresponding lengths on the cores individually. The leading end sections of the succeeding lengths of sheet material are automatically wound on individual cores. Once a desired length of sheet material has been wound on a respective core the trailing sheet material free of the core is automatically severed adjacent the wound roll and the winding of a next roll commences on a new core presented to the drive or winding drum. The previously finished wound roll is automatically ejected from the machine but prior to ejection a leader tape is advanced longitudinally and applied to a trailing end of the length of material on the wound roll. The leader tape is severed and a tab is formed, if desired, on the trailing end by use of a roll reversely folding outwardly and back over itself the trailing end section to form a tab on the wound roll for easy access to the wound material thereon. The steps are repeated to make as many wound rolls as desired.

7 Claims, 13 Drawing Figures

WINDING MACHINE

BACKGROUND OF THE INVENTION

This invention relates generally to wound rolls of sheet material and, more particularly to a method and apparatus for winding into rolls sheet material from a web.

Semiautomatic machines for winding into rolls of sheet materials from larger rolls or webs are well known. These machines require several manual operations during the winding operations. Thus, although the actual winding may be automatic, some of these machines may require manually starting winding operation on each core of the sheet material or may require manual severing of the sheet material after each wound roll has been completed while the next winding operation of the sheet material must be fed manually for effecting the next winding sequence. Thus, these machines are highly limited as to their efficiency and rate of production so that the cost of the wound rolls of material is obviously increased. Furthermore the known winding machines do not wind uniform wound rolls.

SUMMARY OF THE INVENTION

It is an object of the present invention to provide a roll-winding machine or apparatus for winding rolls of sheet material which is completely automatic once started and eliminates the manual operations required in the known winding machines.

Another object of the present invention is to provide a roll-winding machine capable of automatically winding a leader or leading tape on the trailing end of a length of sheet material wound onto a core for easy removal of the sheet material from the wound roll of the material.

Another object of the present invention is to provide an apparatus in which the roll-winding operation takes place at a fixed speed irrespective of any changes in the diameter of the roll being wound.

Still another object is to provide a roll-winding machine for sheet material which consistently maintains a high quality production of wound rolls efficiently.

Yet another object of the present invention is to provide a general purpose type roll-winding machine which is relatively compact and smaller in size than the known apparatus.

Another object of the invention is to provide a roll-winding machine that eliminates any waste of the sheet material and uniformly winds rolls of the sheet material so that all of the wound material is usable.

Another object of the invention is to provide a winding machine wherein the various devices thereof are of simple construction and perform the operations thereof smoothly in a desired sequence with the sheet material being wound into rolls travelling in one direction.

The method of the invention is carried out by continuously advancing longitudinally along a path a sheet of material to be wound into individual rolls, each having a desired length of the sheet material wound thereon. While the sheet material is advanced elongated cores are sequentially presented individually and rotated about their individual axis disposed continuously during a winding operation transversely of the path of the travelling sheet material and over this path. Air is applied underneath the leading end section of the travelling sheet material and it is guided reversely over itself and over and onto a rotating core which is disposed over the path of the travelling sheet and on the travelling sheet. The leading end section is guided over the individual cores for automatically starting the winding of the leading end section thereon.

The application of air and guiding of the sheet is terminated and the core continuously rotated until a desired length of sheet material has been wound on the core and a completed wound roll made. The sheet material trailing free of the wound roll is then severed and another core free of sheet material is positioned in the path of the sheet material transversely thereof so that the leading end section of the next succeeding length of travelling sheet material is wound on the core in a similar way as described above.

The completed wound rolls are automatically advanced and a leader tape is applied thereto on a trailing end section of the material wound on a particular core. The trailing end is automatically reversely folded outwardly to form a tab on a finished roll for easy removal of the material from the wound roll in conjuction with the leader tape.

In order to carry out the method according to the invention a new and improved apparatus for automatically winding sheet material into rolls is provided with a drum driven rotationally to which elongated cores in use for making rolls of sheet material thereon are presented successively in parallel to the drum making peripheral contact with travelling sheet material for being driven rotationally for winding of the sheet material thereon. Means are provided comprising an intermittently driven mechanism for presenting intermittently cores individually to the drum successively in a desired sequence of a plurality of elongated cores for winding the sheet material thereon and for automatically positioning these cores parallel with the drum, and in peripheral contact with sheet material travelling over the drum, for being driven rotationally by the drum.

The sheet material is fed from a larger roll or web by a feed roll for continuously advancing longitudinally the sheet material to be wound on the cores.

Before a length of the sheet material is wound on a core at the winding position or station, the wound roll is advanced out of its winding position or station to a position or tape-application station where a leader tape is applied to the trailing end of the sheet material wound on the completed wound roll. The sheet material is severed at the winding station in a section trailing behind the wound roll by a cutter blade of the rotating drum housed axially therein and projected outwardly through an axial slot in the drum automatically by air-actuated cylinders and then retracted into the drum. The next successive length of material has its leading end section applied to a next succeeding core advanced into the winding position by the intermittent mechanism for winding in a similar manner.

There is provided at the winding position a mechanism comprising the driven drum itself for reversely guiding the leading end backward and over an individual core for winding of the sheet material on the particular core at the winding position. The mechanism comprises openings or jets on the rotating driven drum and nozzles that at the proper time apply air underneath the leading end section of the travelling sheet material and guide means carries out the guiding over onto a core to start the winding.

In order to apply the leader tape to a finished wound roll at the tape-application station mechanism is provided for advancing tape, from a roll of leader tape. A length of the tape is severed by a scissors-like device and adhered to the trailing end section of the severed sheet material not yet completely wound on the wound roll. The leader is automatically severed from the leader tape roll at proper time for allowing automatic ejection of the finished wound roll. However, prior to the ejection step or delivery to an ejection station the rotatably driven completed or wound roll may have a driven roll applied thereto at the trailing end of the sheet material wound thereon while rotating in an opposite direction to reverse-fold the marginal portion of the trailing end section of the wound tape to form a tab with the material itself on the wound roll.

BRIEF DESCRIPTION OF THE DRAWINGS

The invention will become more readily apparent from the following detailed description taken in conjunction with the appended claims and accompanying drawings in which:

DESCRIPTION OF THE PREFERRED EMBODIMENTS

Figure 1:
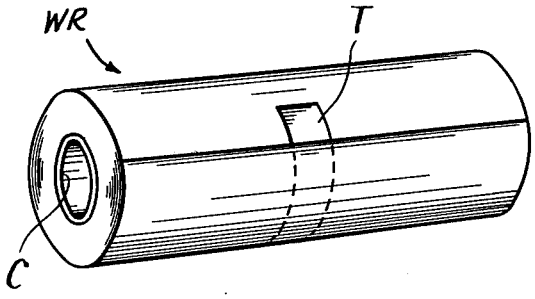
FIG. 1 is a perspective view of a wound roll of sheet material according to the invention without formation of a tab thereon.
Figure 2:
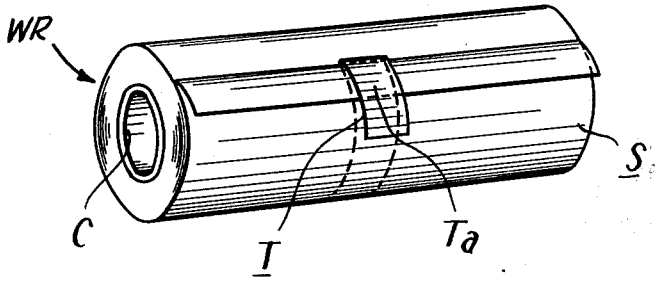
FIG. 2 is a perspective view of a wound roll of the type in FIG. 1 subsequent to formation of a tab on a trailing end of the sheet material on the wound roll.
Figure 3:
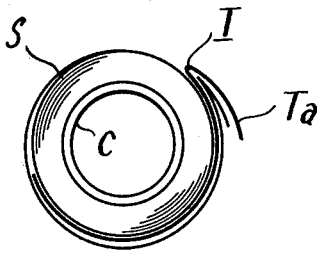
FIG. 3 is a side end view illustrating the finished wound roll in FIG. 2.

A roll-winding machine according to the invention, and hereinafter described, automatically produces successive wound rolls WR of a sheet material wound on individual cores C having a leader tape T automatically applied to the trailing end of the length of sheet material that has been severed from the source of sheet material once a roll has been wound. Mechanism has been provided in the roll-winding apparatus and method according to the invention for automatically developing a tab T*a* by reversely folding back onto itself a marginal edge portion of the trailing end section of the length of winding material wound on a finished roll WR as shown in FIG. 2.

The roll-winding machine can wind different kinds of sheet material which may be of a heavy or light stock and may be paper, film, wallpaper, or foils and the like. In the event that a substantially heavy stock of sheet material is to be wound the formation of a tab T*a* may not be necessary.

Figure 4:
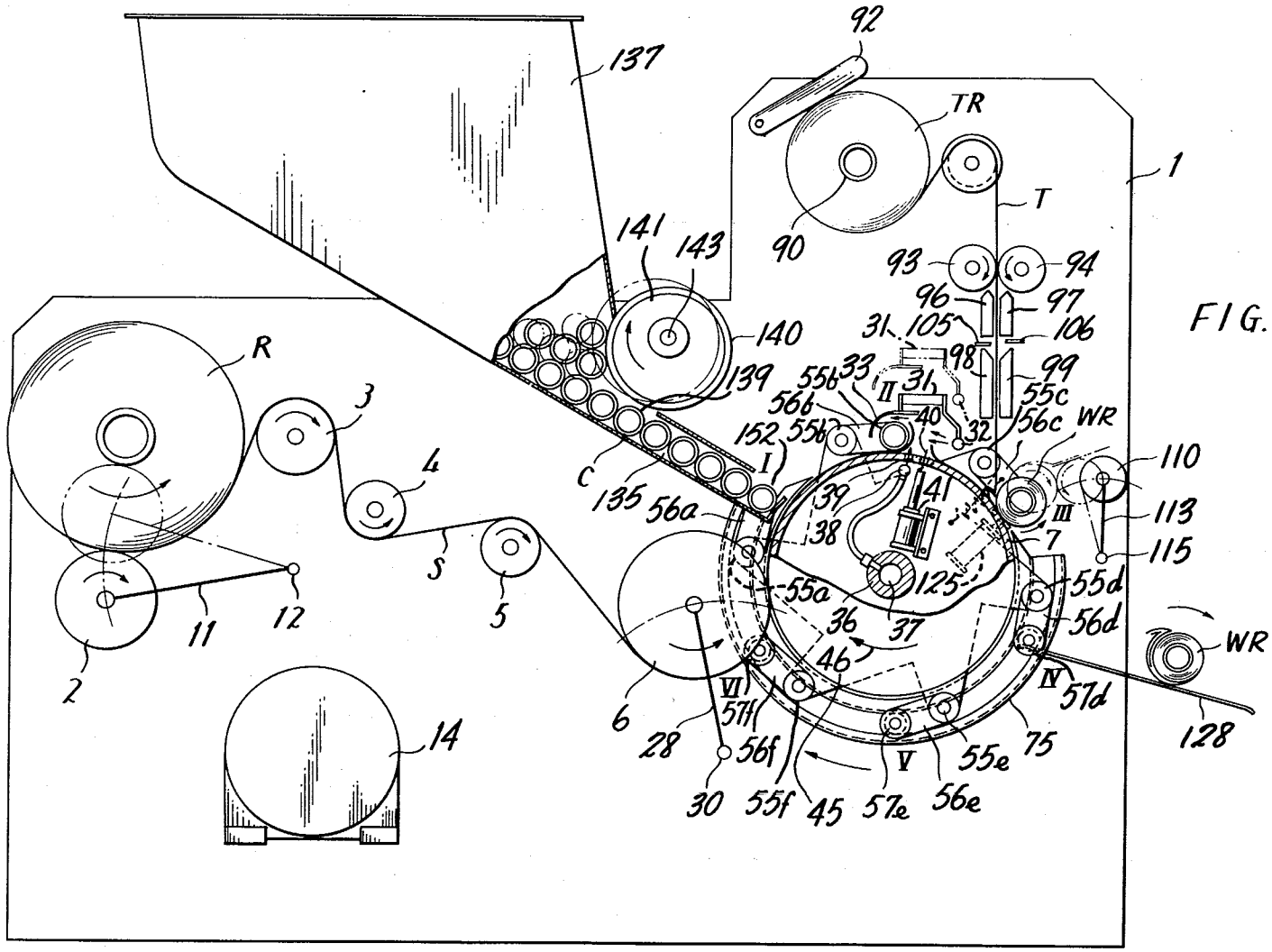
FIG. 4 is a diagrammatic elevation view partly in section and partially cut away illustrating the overall construction of a roll-winding machine for winding sheet material on cores according to the invention.

The short rolls or individual wound rolls WR are made in a roll-winding machine or apparatus as shown in FIG. 4 in which a frame 1 has mounted within it a web or large roll R of a sheet material S rotational on a pivot or shaft as shown. The sheet material S thereon is fed from the web or roll R by a feed roll 2 over driven guide rolls 3, 4, and 5 and advanced longitudinally through a nip of a nip roller 6 and a driven winding drum 7.

The delivery or feed roller 2 is pivotally mounted on arms 10, 11 which themselves are pivoted by a shaft 12. The arms 10, 11 are biased for maintaining the feed roll 2 in constant contact with the sheet material on the web R, for example, by air cylinders, not shown. The various rolls heretofore described in the winding machine are driven from a common power source or motor 14 which drives a drive 15 rotatably driving a drive shaft 16 mounted on the frame 1 for rotation to which are connected a drive 17 for driving a gear drive mechanism or connection 19 to rotatably drive guide rolls or rollers 3, 4 rotatably mounted on individual shafts driven by the various drives. A drive 20 driven from the roll 3 is connected to a drive 23 for driving the feed roll 2. A drive 24 driven from the drive shaft 16 drives the third guide roll 5 and a drive 26 driven from the same source drives the winding drum 7 rotatably continuously in use at the same continuous speed of rotation. The guide rolls or rollers are driven at approximately the same peripheral speed as the peripheral speed of the delivery or feed roll 2.

The nip roll 6 is pivotally supported on a pair of pivot arms 28, only one of which is shown. Both pivot arms are pivoted on a pivot 30. The pivot arms 28 are biased in a direction, for example, with air cylinders, not shown, maintaining the nip roll 6 defining a nip under pressure between itself and the driven winding drum 7 which is driven in a clockwise direction of rotation and the nip roll 6 rotates in a counterclockwise direction.

The travelling sheet material S moves over the periphery of the driven drum 7 past a station I, shown in FIG. 4 at a point where individual cores C are sequentially delivered for winding of the sheet material thereon as hereinafter described. The leading end section of the travelling sheet material arrives at a station II at which is located an air-actuated device 31 cooperating with the driven winding drum 7 for initiating the winding of the sheet material on a core C, located at the station II, by winding the leading end section of the sheet material on the core C which itself is in contact with the travelling sheet material and pressed against the winding drum 7 so that it is rotatably driven. The air-actuated initial winding device 31 comprises a nozzle 32 with an arcuate guide or hood 33 fixed thereto. The entire air-actuated device 31 is able to move from a lowered position shown in FIG. 4 in solid black lines to a raised position shown in broken lines. As part of the air-actuated mechanism for starting the winding operation the rotatably driven winding drum is provided with a plurality of apertures 35 spaced from each other axially on the drum. The winding drum is mounted for rotation on a shaft 36 having an axial bore 37. A nozzle 38 is connected interiorly of the winding drum to the axial bore 37 of the shaft 36 which is provided with air under pressure from a source, not shown. The air-actuated mechanism 31–38 operates as later described.

Provision is made for severing the travelling sheet material S once the desired length of sheet material has been wound on a respective or corresponding core C at the station II. Thus the rotary driven winding drum 7 is provided with an axial slit 39 that is circumferentially spaced from the openings 36 in a direction toward a downstream direction relative to the direction of travel of the travelling sheet material. A cutter blade 40 is mounted within the rotary winding drum 7 for being automatically projected outwardly of the drum through the slit 39 for severing the travelling tape S after a wound roll is completed at the station II and is advanced, as later described, to a station III as a fully wound roll WR. The severing mechanism in the apparatus comprises the cutter blade 40 which is actuated by a pair of air cylinders 41 symmetrically mounted within the rotary drum 7 and communicating through a connection, not shown, with the bore 37 of the shaft 36. The cutting blade 40 has a length greater than the width of the travelling sheet material S and is automatically actuated to extend through the slit 39 and automatically retracted as later described.

The roll-winding machine is provided with automatic controls or system wherein a detector detecting the number of revolutions of the rotary drum or winding drum 7 detects the length of sheet material S wound on a wound core for automatically developing a signal just before the desired length of wound material is achieved to control valving through a valve, not shown, of air under pressure to the actuating air cylinders 41 so that the cutter blade 40 is automatically extended to sever the sheet material S trailing from the wound roll which has been advanced from the winding station II to the third station III. The cutter blade 40 is projected and retracted automatically.

Figure 7:
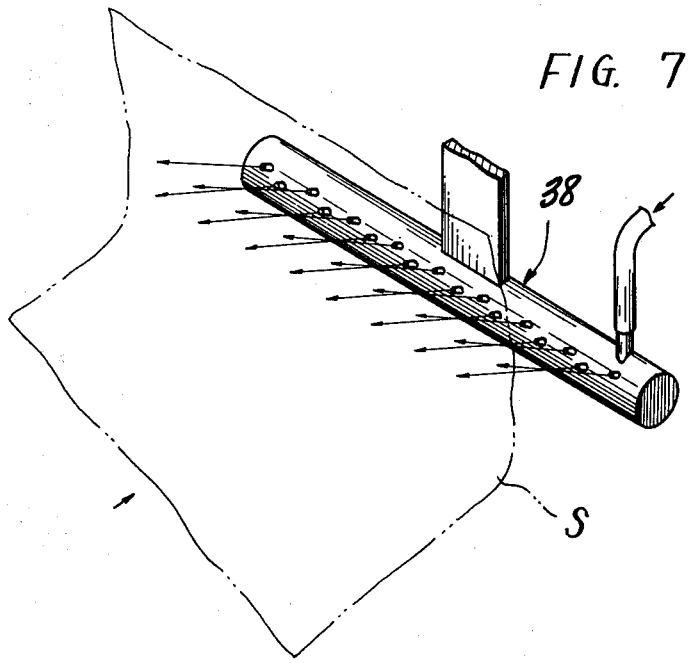
FIG. 7 is a diagrammatic perspective view of an air-actuated device for initiating starting of a winding operation of the leading end section of sheet material on a core according to the invention.

At almost the same time but shortly thereafter, the control mechanism of the invention controls the application of air under pressure by the nozzle 38, FIG. 7, so that air is expelled through the nozzle openings 35 and the leading end section of the next successive length of sheet material can be wound on its corresponding next successive core C now disposed at station II as hereinafter explained. The leading section of the sheet material is lifted from the rotary drum as shown in FIG. 7. As the leading end section of sheet material of the next successive length is lifted the nozzle 32 is triggered by the control system for a time, and it applies air to the backside of the lifted leading end section so that the travelling sheet is reversely guided by the arcuate hood 33 over and onto the rotatably driven core C at station II with the air-actuated device 31 in its down position so that the leading end section is automatically wound on the core C and winding of the sheet material is initially started and continues as the core is rotatably driven by the driving drum or winding drum 7. The air-actuated device 31 is automatically actuated to its raised position shown in broken lines in FIG. 4 under control of the control system controlling air cylinders, not shown, for moving the air-actuated device 31. This air-actuated device 31 is returned to the lowered position before the leading end section of the next length of sheet material is to be wound on a successive core C.

Those skilled in the art will recognize that in this manner successive lengths of the sheet material on the web R can be wound on individual cores rotatably driven about their longitudinal axis by the travelling sheet material and the driving or winding drum 7. The mechanisms for automatically initiating the winding of the leading end section of the first length of sheet material can be obviously manually controlled for initiating the winding of the first length to be wound and thereafter all of the operations are automatically controlled.

In order to deliver cores C from a core supply, later described, individually and sequentially to the winding station II at the proper times, the winding machine is provided with an intermittent advancing mechanism having multi-spindle type turrets 45 at opposite ends of the rotary drum 7. The turrets are intermittently driven in a same direction as the direction of rotation of the winding drum as shown by an arrow 46 through a gear drive 48 selectively connected by an electrically controlled electromagnetic clutch 49 connecting a drive 50 to the main driven shaft 16. The electromagnetic clutch 49 is energized by the control system of the machine by an electrical signal transmitted before the desired length of sheet material S wound on each core C is completely wound thereon so that rotation may be affected by 60° increments each time.

Figure 8:
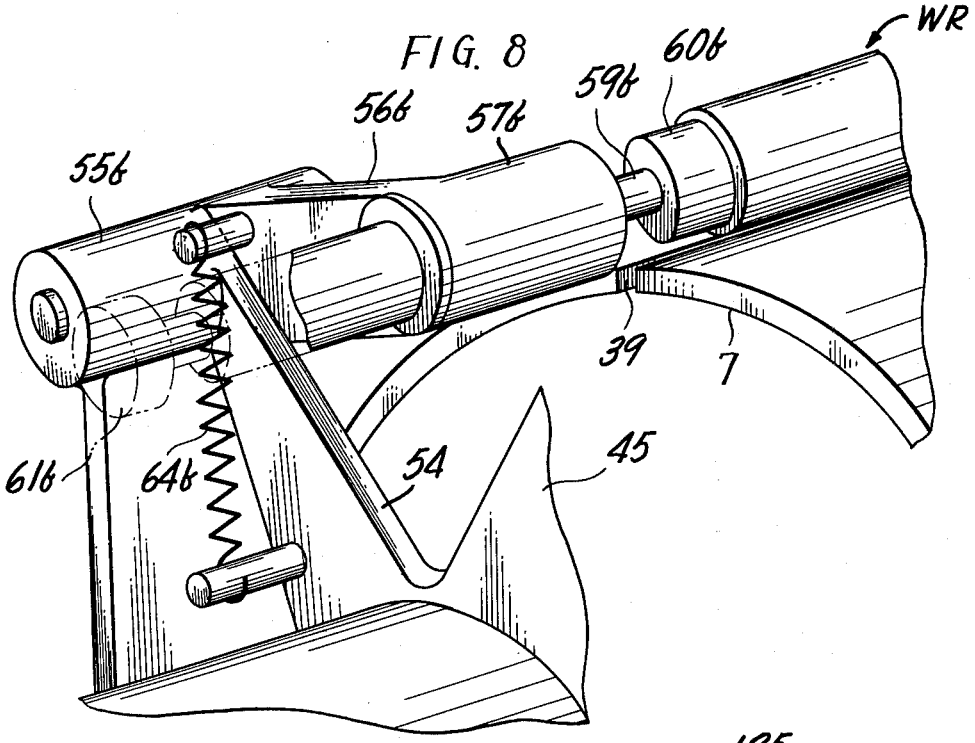
FIG. 8 is a fragmentary perspective view, on an enlarged scale, of intermittently-operated mechanism for feeding cores successively and individually to the apparatus in FIG. 4 and advancing the cores from station to station on the winding drum of the apparatus.
Figure 9:
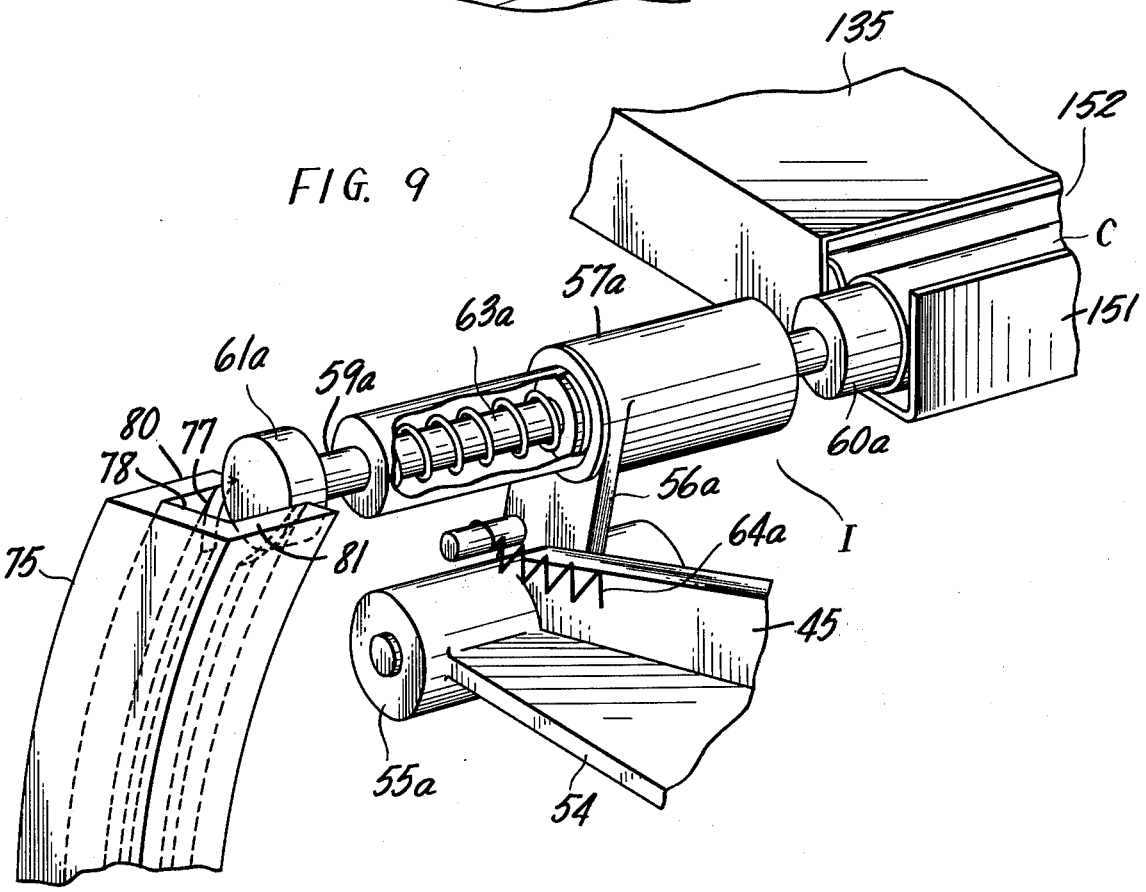
FIG. 9 is a fragmentary diagrammatic perspective view of the intermittent mechanism illustrated in FIG. 8 with a cutaway to illustrate construction and mode of operation.

The turrets 45 each have six arms 54 each provided with a head **55*a*–55*f* as shown in FIGS. 4, 8 and 9, on which are pivotally mounted lever arms 56*a* to 56*f* each carrying a bearing sleeve 57*a*–57*f* in which is axially displaceable a chuck-actuating rod, for example rods 59*a*, 59*b*, 59*c* connected to a chuck, for example chucks 60*a*, 60*b*. Each rod has a head, 61*a*–61*c*, for example, that functions as a cam follower. Each chuck is insertable automatically into an end of a core C at the station I and is biased by a respective spring, only one 63*a* which is shown, in a direction toward a projected position in which it is projected axially into a corresponding end of a core C. The individual lever arms are biased by a corresponding spring, only some 64*a*, 64*b* are shown, connected to the corresponding lever arm and to its corresponding turret arm 54 to maintain the individual chucks biased in a direction for holding the cores, when carried thereon, as hereinafter described, in contact with the travelling sheet, and when sheet material is wound thereon contacting the surface of the rotary winding drum 7,** over a sector of which the sheet material travels.

Figure 10:
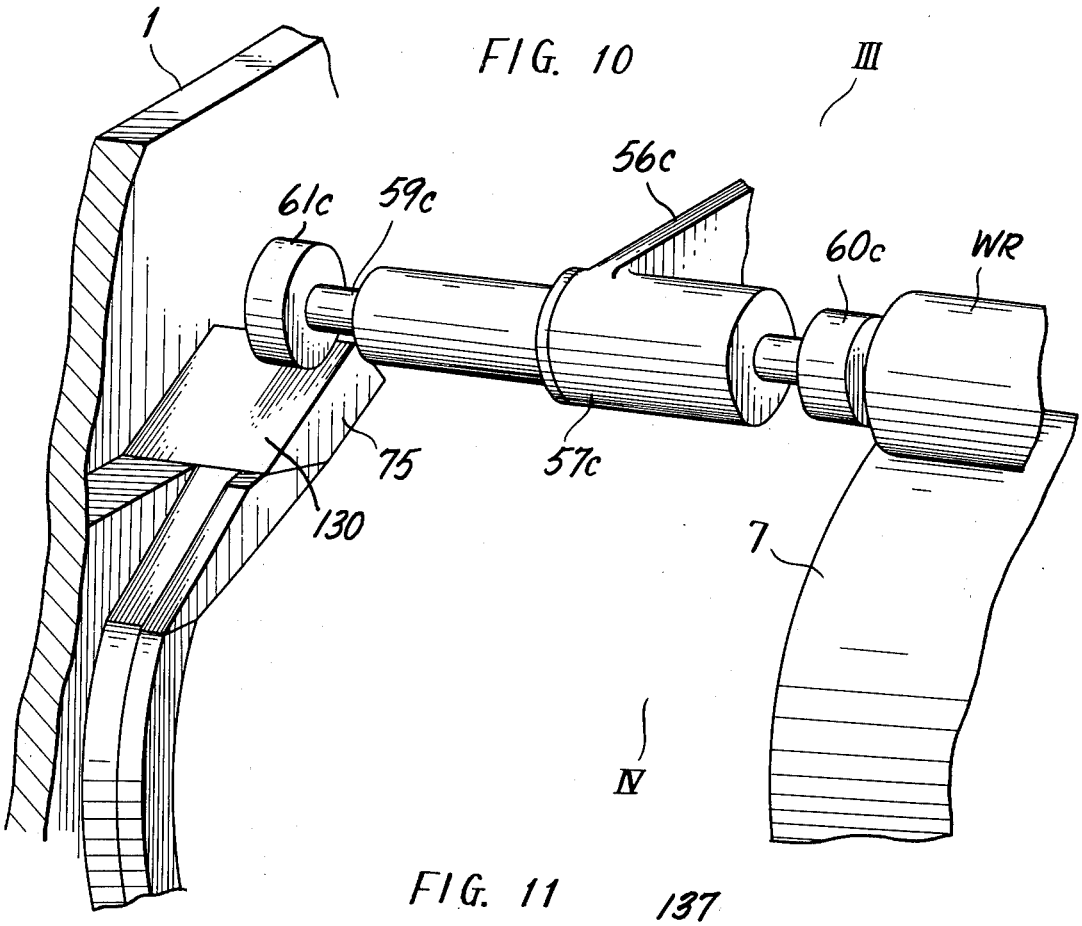
FIG. 10 is a fragmentary diagrammatic view, on an enlarged scale, of cam mechanism for actuating intermittently chucks of the intermittent mechanism illustrated in FIGS. 8 and 9.
Figure 11:
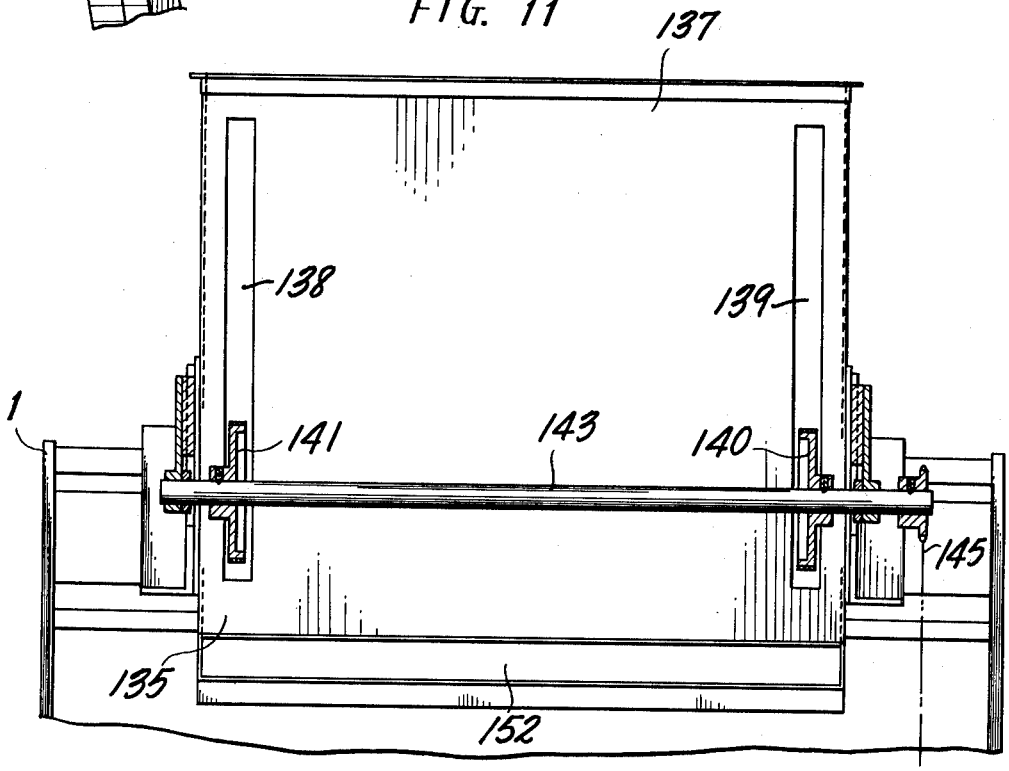
FIG. 11 is a fragmentary elevation view of a core-supply device of the apparatus illustrated in FIG. 4.

The winding machine is provided with semi-circular or arcuate cams 75 at opposite ends of the rotary winding drum 7. Only one of these cams is shown in FIGS. 4, 9 and 10 and both are shown schematically in FIG. 4, for controlling "in" and "out" movements of the chucks axially for insertion into a corresponding core and retraction therefrom as later explained.

Each arcuate cam 75 is approximately a semi-circle which is concentric with respect to the shaft of the rotary drum 7 and the arcuate cams provide sequential delivery of the cores to the winding station II on the rotary winding drum 7 in conjunction with the turrets to move the cores from station to station as hereinafter explained.

Each cam 75 actuates the cam followers and is provided for this purpose with a groove 77 having a bottom 78 and sides 80, 81. The groove is contoured to automatically carry out control of the chucks through the cam followers. In the position illustrated in FIG. 9 as a cam follower 61*a* leaves the cam at a core pick-up station I the chuck 60*a* is actuated axially by its individual biasing spring 63*a* so that it is inserted into an end of a core in the position or station I as illustrated in FIG. 4. It will be noted that the cam terminates adjacent the core pick-up station I in order to allow the individual chucks to be activated for insertion individually and sequentially into individual cores.

As the turrets are rotated 60° intermittently a core C is moved from station to station. A core C picked up at the first or pick-up station I is advanced to the winding station II for winding of sheet material thereon as described heretofore and after the roll is substantially completely wound in the next successive movement of the turrets it is advanced to the station III for application of a leader tape T as hereinafter described. During the transfer of each core C from station I to station II and on to station III, the cam followers are free of control of the control groove of each control cam 75.

Figure 12:
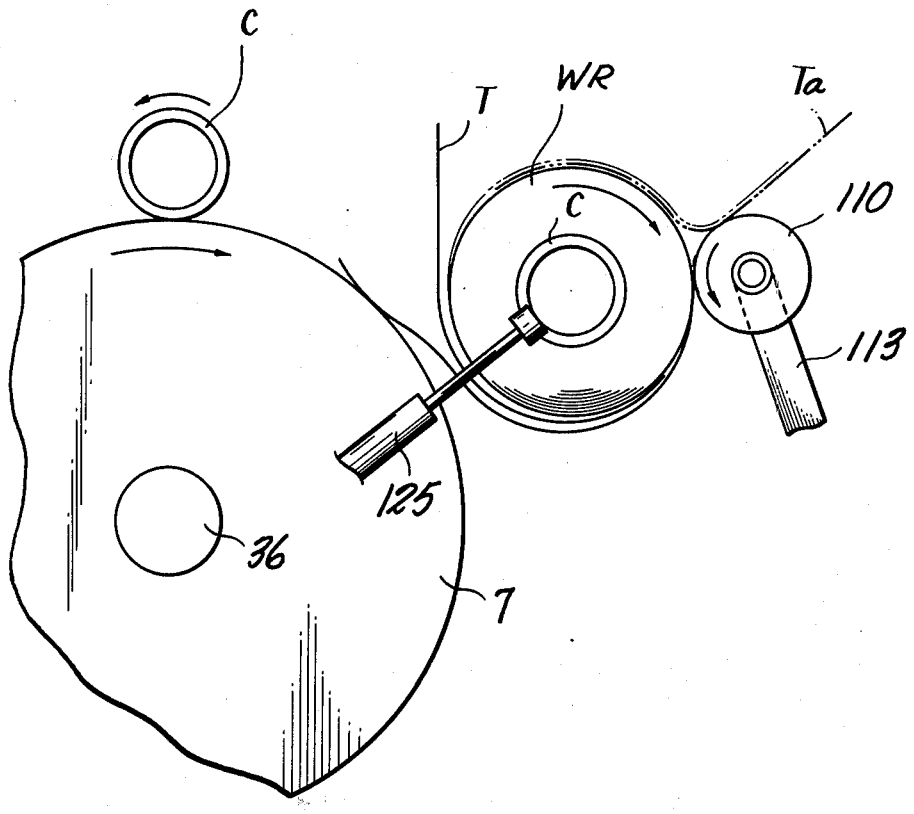
FIG. 12 is a diagrammatic elevation view of a part of the roll-winding machine in FIG. 4 and particularly illustrating tabforming mechanism on the roll-winding machine.

In order to apply a leader tape T to a wound roll WR a tape roll TR is rotatably mounted on a shaft 90 and is pressed by a brake roll 92 to help maintain the advance of a film tape T smooth by feed rolls 93, 94 and between guides 96–99. The tape is advanced by the feed or nip rolls 93, 94 on command and control of a signal applied to an electromagnetic clutch 101 which is part of a drive 102 driven from the driven shaft of the rotary winding drum 7. This signal is developed by the control system, later described, to advance the tape T when a completely wound roll WR is in station III and the trailing end section of the sheet material, after severing by the blade cutter, has not been completely wound. The tape is advanced into a position where it is picked up by the rotating wound roll WR rotatably driven by contact with the periphery of the rotary drum 7 so that as the trailing end of the sheet material continues to be wound the leader tape T is placed in contact therewith and wound into the roll as shown in FIGS. 4 and 12. The tape T is cut at the proper length of leader required by scissor-like cutter blades 105, 106 on command of the control mechanism and a signal applied to the nip rollers 93, 94 advances the tape again into position for readiness for insertion into a next successive wound roll.

If a heavy sheet material is being wound into a roll, it may not be necessary for developing a tab on the trailing end section of the wound material to make it easy to remove the material or initiate taking thereof from the roll. However, where a light stock sheet material is wound, provision is made in the winding machine according to the invention to develop a tab T*a*. Thus, a driven tab-forming roll 110 is mounted on arms 112, 113 secured to a shaft 115 driven through a drive 116 under control of an electromagnetic clutch 120 connected to a drive 121 driven from the shaft of the rotary winding drum as illustrated.

The roll-winding machine is provided with a pair of lifting air-cylinders 125 that are mounted within the winding drum symetrically and are actuated by the same signal actuating drive of the roller 110 so that the wound roll WR is lifted by lifting the lever arms of the roll-holding chucks in the manner shown in broken lines diagrammatically in FIG. 4 and in solid lines in FIG. 12 into contact with the tab-forming roll for carrying out the forming of the tab. The tab-forming roll 110 is driven in a counterclockwise direction while the wound roll WR is driven in a clockwise direction so that the trailing end section of the sheet material in the tape is reverse-folded backwardly as shown in FIG. 12 to form a tab on the wound roll for easy removal of sheet material as heretofore explained. The tab-forming operation requires only a short time and the lifting air-cylinders are retracted upon forming of the tabs so that the chucks holding the wound roll WR restore the wound roll to the surface of the winding drum.

Once the tab has been formed on the wound roll WR, the roll continues to be pressed by the tab-forming roll 110 and roll-lifting air cylinders 125 restore it to the position shown in full lines in FIG. 4. The tab-forming roll is retracted to the position shown in solid lines in FIG. 4 under command of the controls of the apparatus. On the next sequential incremental movement of the turrets the wound roll WR is moved to the position illustrated in FIG. 4 at a fourth or discharge station IV in which the cam followers of the chucks holding the wound roll are activated by the cam groove so that they are retracted and the wound roll WR is released and allowed to be removed in a finished condition therefrom along a chute 128. The finished roll may be transmitted to another station, not shown, where it may be packaged.

Keeping in mind that there are two turrets and only one is herein described the turret arm having the lever arm 56*c* having the chuck 60*c* has the finished roll WR thereon. In entering the cam 75 the cam follower 61*c* will engage a flat ramped surface 130 so that it enters the cam groove to unload the finished or wound roll at the fourth station IV. One of the chucks transporting the finished roll WR from the third station III to the unloading or fourth station IV is shown in transit between these stations in FIG. 10. The preceding lever arm 54*d* is illustrated at the fourth station where the wound roll it was transporting has been released on to the discharge chute 128. The cam groove 77 has cammed the cam follower on this arm to a position retracting the chucks associated with this lever arm 54*d* for carrying out the release of its wound roll WR.

Upon leaving the unloading or fourth station IV the chucks are advanced to two other stations V and VI sequentially before they arrive at the first or core pick-up station I. During this movement the cam grooves 77 maintain the cam followers travelling biased to a position wherein the corresponding chucks free of cores C are kept in a raised position clear of the winding drum. In travelling throughout the path of the cam groove 77 this raised condition allows the travelling sheet S to travel from the sixth station VI to the winding station II in contact with the periphery of the winding drum underneath the chucks.

Figure 5:
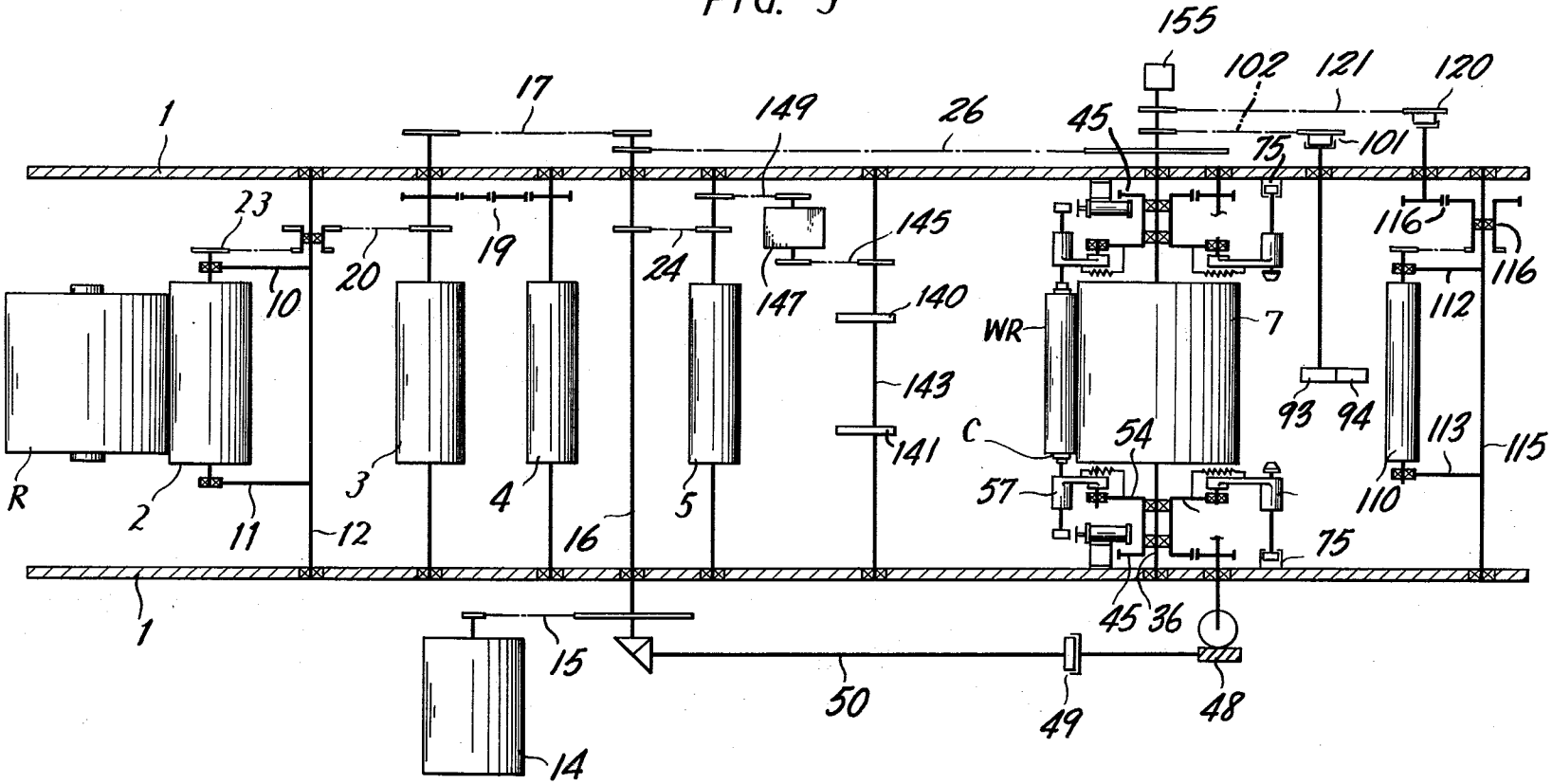
FIG. 5 is a diagrammatic plan view of a part of the roll-winding machine illustrated in FIG. 4.
Figure 6:
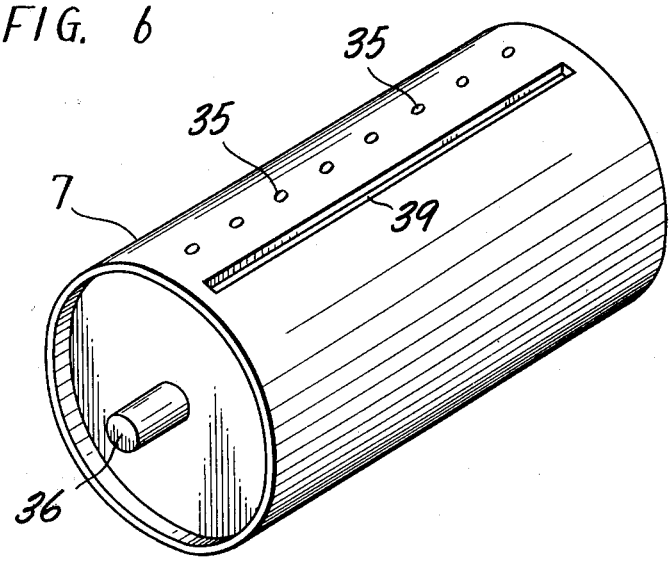
FIG. 6 is a perspective view of a winding drum of a roll-winding machine according to the invention.

As indicated heretofore, the cores C are delivered at core pick-up station I where they are picked up by the chucks free of groove cam 75 as before described. The cores C are delivered in sequence one-by-one into a pick-up position at the first station I transversely of the path of the sheet material S being advanced longitudinally and on to this sheet material at the winding station II as shown in FIG. 4. They are delivered through a sloped chute 135 from a hopper or storage bin 137. The hopper has a slanted front wall and sloped bottom with slits 138, 139 in the front wall and the chute through which eccentric discs 140, 141 axially spaced on a driven shaft 143 and fixed eccentrically thereon engage the cores. The eccentric discs are rotated in a clockwise direction as viewed from the end of the shaft 143 in FIG. 4 to maintain the cores travelling one-by-one in sequence through the chute 135. The rotary driven shaft 143 is driven by a drive 145 connected to a reduction gear 147 which, in turn, is driven by a drive 149 driven from the shaft of one of the driven guide rolls as illustrated in FIG. 5. The chute 135 has an end wall 151 at the pick-up station I and an opening 152 through which the cores are removed upon being picked up sequentially by the core-holding chucks described heretofore.

OPERATION

The roll-winding machine is provided with a control system 155 that controls the proper sequencing of the various operations. An embodiment of such control system is now illustrated in reference to the circuit diagram in FIG. 13.

Figure 13:
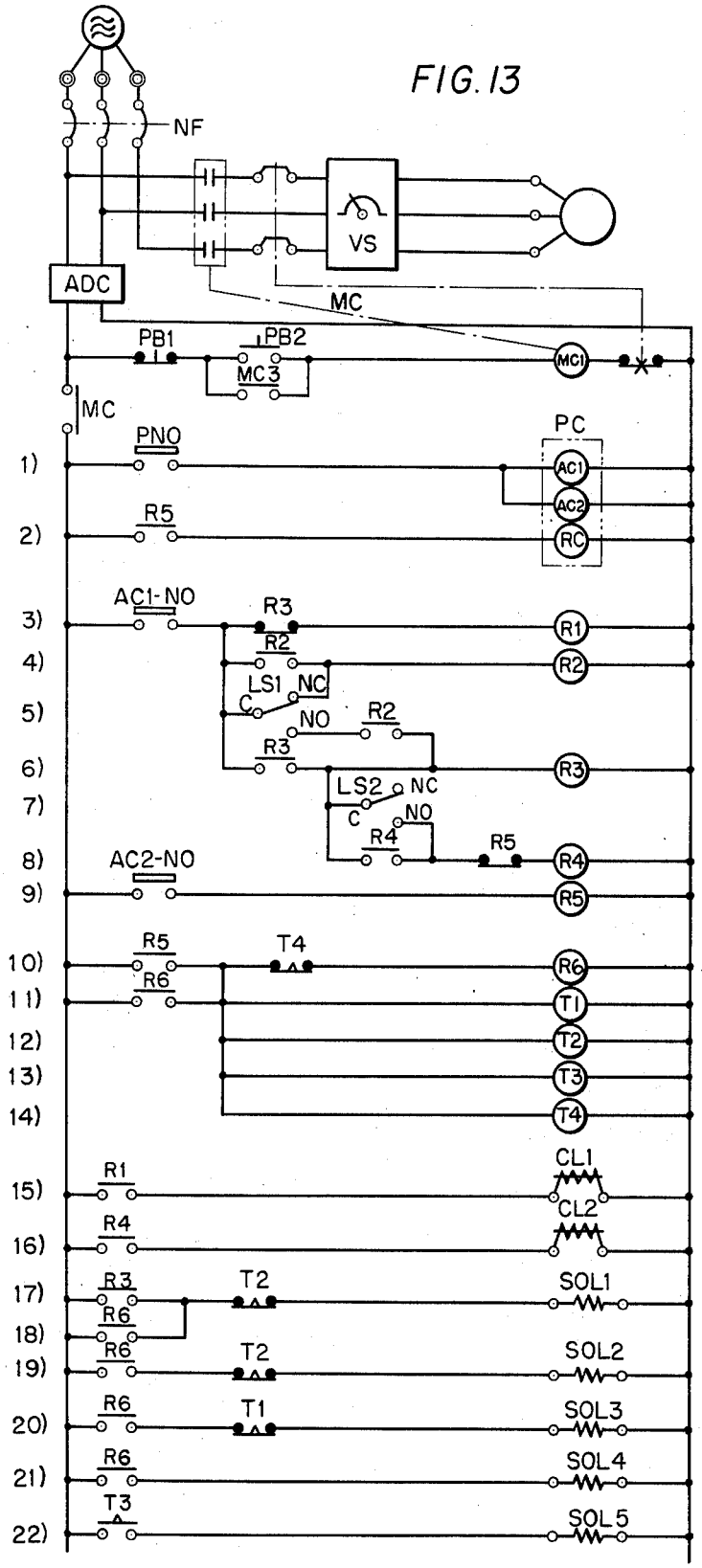
FIG. 13 is a schematic diagram of the controls of the roll-winding machine according to the invention.

In FIG. 13, NF indicates a no-fuse breaker for on-off operation of the power source and for preventing overloading and short-circuiting of the related circuits. VS is a controller for controlling the speed of the motor 14, and ADC is a power device for providing the control circuits with power, for example, DC 24 v. PB1 is an off push-button switch and PB2 an on push-button switch, MC1 is an exciting coil of magnetic contacts for the motor 14 and the control circuits.

PC is a pre-set counter which functions as a center to actuate the sequential operations of the winder and is provided with a counting device AC1 to develop a first signal after being actuated, a counting device AC2 to develop a second signal, and a reset device RC to reset both the counting devices AC1 and AC2, the counting devices AC1 and AC2 being automatically reset when the power source is cut off. The pre-set counter PC is further provided with a normally open contact AC1-NO which closes when the counting device AC1 attains a pre-set value $\beta$ and a normally open contact AC2-NO which closes when the counting device AC2 attains a pre-set value $\alpha$. On receiving the signal, each of the contacts AC1-NO, AC2-NO closes for several hundred milliseconds and then opens. The normally open contact PNO is a pulse switch which applies a pulse to the pre-set counter every time the slit 39 reach the station I by one rotation of the rotary drum 7, so as to count the number of the rotation of the drum.

R1 to R6 are auxiliary relays each provided with adequate numbers of normally open and normally closed contacts (hereinafter abreviated as N.P. and N.C. contacts respectively) in the branch lines from 1) to 22) of the control circuits.

T1, T2, T3, and T4 are contacts, inserted in each branch line, of on-delay timers T1, T2, T3, and T4 acting on the cutter blade 40, the air nozzles 38 and 32 and the arcuate guide 33, the tub-forming roll 110, and the relay R6, respectively.

LS1 is a limit switch for detecting the position of the turrets 45 and switches over its contacts upon coming in contact with a switch dog fixed to each arm of one of the terrets, which adds up to six in this embodiment, thus regulating the position of the turrets so that a core is situated just at the winding station II. LS2 is a limit switch which develops a signal to start operation to the clutch 101 for driving the nip rolls 93, 94 of leader tape, by switching over its contacts upon coming in contact with a switch dog fixed to the shaft of the rotary drum 7. This switch dog is so positioned as to come in contact with the limit switch LS2 when the station I is reached by a point on the rotary drum 7 ahead of the slit 39 in the direction of rotation by an angle a little more than $2\pi$/(number of arms of a turret), 60° in this embodiment. Thus, the limit switch LS2 operates when the slit 39 on the drum 7 has advanced to the position spaced at an angle of a little more than $2\pi$/(number of arms) in the upstream direction of the station II, a little toward the station VI from the station I in this embodiment, and when the slit 39 is further advanced just to the station II and the pulse switch PNO applies a pulse, the cutter blades 105, 106 are operated and a length of leader tape T slightly longer than 1/(number of arms) peripheral length of the drum is advanced, since the peripheral speed of the nip rolls 93, 94 is equal to that of the drum 7.

CL1 is the solenoid of the electromagnetic clutch 49 for revolving the turrets 45 and couples the turret shaft with the motor 14 when excited. CL2 is the solenoid of the electromagnetic clutch 101 which drives the nip rolls 93, 94 for advancing leader tape T, when excited.

SOL1 is a solenoid of an electromagnetic change-over valve in the air line for lowering the arcuate guide 33, SOL2 is a solenoid of an electromagnetic change-over valve in the air line for operating the air nozzles 38, 32, SOL3 is a solenoid of an electromagnetic change-over valve in the air line for actuating the cutter blade 40, SOL4 is a solenoid of an electromagnetic change-over valve in the air line for actuating the scissors-like cutter blades 105, 106, and SOL5 is a solenoid of an electromagnetic change-over valve in the air line for biasing the tab-forming roll 110 and actuating the air cylinders 125 to lift the full roll.

In order to control the sequencing of the operations the control system uses the winding drum and its peripheral dimension as a reference. Thus, if the winding drum has a circumferential dimension of $a$ meters, the counter PC can count the revolutions as the factor indicating the length in the unit of $a$ meters of the individual lengths of sheet material S advanced for winding on a core, and control according to the count the generation and application of electrical signals to various solenoids and the like that control the actuators that carry out the various operations.

In the operation, a web or large roll R is set to the machine and the leading end of the sheet material S is led by hand, as shown in FIG. 4, through guide rolls 3, 4, and 5, the nip roll 6, and over the winding drum 7 to the winding station II and is wound there on the core to some length. The feed roll 2 and the nip roll 6 are pressed by the operation of a hand valve. The pre-set counter is set in advance so that the counting device AC1 develops a signal upon counting up to $\beta$ and the counting device AC2 upon counting up to $\alpha$. The value $\alpha$ here is larger than $\beta$ and $\gamma = \alpha - \beta$ must always be constant, since the gear ratios are so fixed that the drum 7 rotates $(\gamma - 1)$ times while the turrets revolve 1/(number of arms) turn.

The push-button switch PB2 is then pushed to start the operation. The magnetic contacts are closed and sustained by a contact MC3, and the motor 14 and the control circuits are connected to the power source.

When the count has reached $\beta$, the counting device AC1 develops a signal to close the contact AC1-NO, which sustains this condition until a reset signal is applied by the counter. At the same time, the relay R1 is excited to close the N.O. contact of R1 in the branch line (15), and the solenoid CL1 of the clutch 49 is excited to start the revolution of the turrets 45. After the turrets 45 have left the stationary position, the limit switch LS1 closes its contact C – NC, and the relay R2 is self-locked, that is, the leave of the turrets 45 from the stationary position is memorized by the relay R2. When the turrets 45 have advanced to the next stationary position, the limit switch changes over to close its contact C – NO, and the relay R3 is self-locked. At this time, the N.C. contact of relay R3 in the line (3) opens to reset the relay R1 to the original state and the N.O. contact of R1 in the line (15) is opened to release the clutch 49, and the turrets are stopped. On the other hand, the N.O. contact of R3 in the line (17) is closed to excite the solenoid SOL1 of the electromagnetic valve for actuating the air cylinder for lowering the arcuate guide 33, and it is lowered together with the air nozzle 32.

The gear system of the apparatus is so designed that during the period from the delivery of a first signal of the counting device AC1 to the excitation of the relay R3, namely, while the turrests 45 revolve 1/(number of arms) turn, the drum rotates $\gamma - 1$ times. Therefore, one more rotation of the drum 7 advances a length of sheet material up to $\alpha$ unit. The limit switch LS2 is actuated prior to it and after the excitation of the relay R3, when the slit 39 of the drum 7 is positioned slightly more than 1/(number of arms) turn upstream of the winding station II, as above described; namely, a slightly more than 1/(number of arms) turn of the drum 7 will bring the slit 39 to the winding station II. The actuation of the limit switch LS2 excites the relay R4, which is self-locked, and closes the N.O. contact of R4 in the line (16) to excite the solenoid CL1 of the clutch 101 and advances leader tape T by the nip rolls 93, 94.

When the count has reached $\alpha$, the counting device AC2 develops a second signal to close the contact AC2-NO and the relay R5 is excited. At the same time a pulse is applied by the N.O. contact R5 in the line (2) to the reset device RC of the counter PC, and it carries out resetting operation, the period of which is the same as that the contact AC2-NO is closed, several hundred milliseconds as described above. This operation of the counter opens the contact AC1-NO and restroes the relays R1 to R4 all to the original situation. As the N.C. contact of R5 in the line (8) opens and the relay R4 is reset, the N.O. contact of R4 in the line (16) is opened and the solenoid CL2 of the clutch 101 is deenergized to stop the advancing of the leader tape T.

At the same time, the N.O. contact of R5 in the line (10) is closed and the relay R6 is self-locked. As each N.O. contact in the branch lines (18), (19), (20) and 21) is thus closed, the solenoid SOL3 of the electromagnetic change-over valve for the air cylinders 41 for extending the cutter blade 40 is excites to operate the cutter blade to sever the sheet, the solenoid SOL2 of the electromagnetic valve for the nozzle 38 inside the drum and the nozzle 32 at the arcuate guide 33 is excited to apply air to wind the leading end portion of the sheet S on the core while the arcuate guide 33 and the air nozzle 32 is held at the lowered position, and the solenoid SOL4 of the electromagnetic valve for actuating the cutter blades 105, 106 is excited to sever the leader tape T.

The timers T1, T2, T3, and T4 limit the time after the excitation of the relay R6. The action of the timer T1 opens its contact T1 in the line (20) to deenergized the solenoid SOL3 and the cutter blade 40 is retracted. The action of the timer T2 opens its contacts T2 in the lines (17) and (19) to deenergize the solenoids SOL1 and SOL2, and the application of air from the nozzles 38 and 32 is stopped and the arcuate guide 33 is lifted together with the nozzle 32. The action of the timer T3, which is so set that it limits the time before the full roll transferred to the station IV has completely wound up the trailing end of the sheet material S, closes its contact T3 to excite the solenoid SOL5 for actuating the air cylinders 125 to lift the full roll and the air cylinder to bias the tab-forming roll 110, and the tab-forming operation is carried out. The set time of the timers T1, T2, and T3 are in the range of several hundred milliseconds to several seconds.

The timer T4, which has been set to a longer period of time than the timers T1, T2, T3, then acts to release the self-lock of the relay R6, and the contacts R6 in the line (10) and thereafter, the timers T1 to T4, and the solenoids of the clutches all are restored to the original state. Thus, a cycle of the winding operation is completed and then repeated in the same manner.

I claim:

1. In a roll-winding apparatus for winding sheet material into a plurality of wound rolls comprising; a winding drum rotationally driven at a constant speed of rotation; feed means for advancing a travelling sheet material longitudinally in contact with a peripheral sector of said winding drum; means for automatically presenting elongated cores individually and successively to a winding station at said sector and in contact with said travelling sheet material and pressed thereagainst and against said drum in position parallel with said drum for each being rotationally driven about a corresponding longitudinal axis thereof; said means for automatically presenting elongated cores comprising means biasing the individual cores in a direction toward the periphery of said winding drum; means for winding a leading end section of said sheet material on each successive rotating core at said winding station and each with a desired length of sheet material wound thereon as a wound roll; said means for presenting said elongated cores to said winding drum comprising means to transfer successively would rolls from said winding station to a discharge station on said drum downstream of the winding station while maintaining sheet material wound on each of said wound rolls bearing against said winding drum for rotating by said drum about said corresponding longitudinal axis of each corresponding core; said means to transfer comprising means driven intermittently angularly equal increments about the longitudinal axis of said winding drum; means to automatically sever the sheet material during each transfer of a wound roll from said winding station; and said means for winding said leading section comprising means for automatically winding on each said successive core a leading end section of each next successive length of sheet material after severing of each length of sheet material from said sheet material upon winding thereof on a corresponding core.

2. In a roll-winding apparatus for winding sheet material into a plurality of wound rolls according to claim 1, in which said means to sever the sheet material comprises a cutter blade provided within and longitudinally of said winding drum for being automatically projected outwardly of the drum and retracted to effect said severing of sheet material, means to automatically project and retract said cutter blade, and said drum having a slot through which said blade is projected and retracted.

3. In a roll-winding apparatus for winding sheet material into a plurality of wound rolls according to claim 1, in which said means driven intermittently comprises pick-up means for automatically picking-up said cores individually at a first station and on a next successive incremental angular movement transporting said core to said winding station and subsequently to said discharge station.

4. In a roll-winding apparatus for winding sheet material into a plurality of wound rolls according to claim 3, in which said pick-up means comprises a plurality of angularly spaced chucks rotated about the longitudinal axis of said winding drum intermittently, and means for automatically actuating said chucks axially for insertion into opposite ends of the cores at said first station and for retracting the chucks from the cores at said discharge station.

5. In a roll-winding apparatus for winding sheet material into a plurality of wound rolls according to claim 1, including means for automatically applying a leader tape to said wound roll before discharge thereof at said discharge station.

6. In a roll-winding apparatus for winding sheet material into a plurality of wound rolls according to claim 5, including means to reversely fold a marginal trailing end section of sheet material on at least some of said wound rolls.

7. In a roll-winding apparatus for winding sheet material into a plurality of wound rolls according to claim 1, including means to reversely fold a marginal trailing end section of sheet material on at least some of said wound rolls.

* * * * *